US006439098B1

(12) United States Patent
Dillon

(10) Patent No.: US 6,439,098 B1
(45) Date of Patent: Aug. 27, 2002

(54) AMMUNITION BOX

(76) Inventor: Michael J. Dillon, 8009 E. Dillon's Way, Scottsdale, AZ (US) 85260

( * ) Notice: Subject to any disclaimer, the term of this patent is extended or adjusted under 35 U.S.C. 154(b) by 0 days.

(21) Appl. No.: 09/716,785

(22) Filed: Nov. 20, 2000

(51) Int. Cl.[7] ..... F41A 9/00
(52) U.S. Cl. ..... 89/34; 89/33.14
(58) Field of Search ..... 89/33.14, 33.01, 89/33.2, 34, 33.1, 33.5

(56) References Cited

U.S. PATENT DOCUMENTS

| | | | | | |
|---|---|---|---|---|---|
| 2,464,689 | A | * | 3/1949 | Jackson | 198/1 |
| 4,392,407 | A | * | 7/1983 | LaFever et al. | 89/33 |
| 4,393,746 | A | * | 7/1983 | Rocha | 89/34 |
| 4,412,611 | A | * | 11/1983 | Golden | 198/450 |
| 4,433,609 | A | * | 2/1984 | Darnall | 89/34 |
| 4,972,758 | A | * | 11/1990 | Austin et al. | 89/34 |
| 5,245,908 | A | * | 9/1993 | Sanderson | 89/34 |

FOREIGN PATENT DOCUMENTS

| | | | | |
|---|---|---|---|---|
| DE | 2051356 B2 | * | 11/1977 | 89/34 |
| FR | 815469 | * | 7/1937 | 89/34 |

* cited by examiner

*Primary Examiner*—Charles T. Jordan
*Assistant Examiner*—Gabriel S Sukman
(74) *Attorney, Agent, or Firm*—Frank J. McGue

(57) ABSTRACT

An ammunition box is disclosed. The ammunition box is an open top, narrow width, box-like structure having a bottom, two opposing side walls, a front wall and a rear wall opposing the front wall. The ammunition box further has a vertical divider extending the length and height thereof and bisecting the width of the box thereby dividing the interior thereof into two equal width cavities. Each cavity is adapted to receive the width of an ammunition belt. The box further has a baffle extending the width of each cavity approximately bisecting the length thereof, thereby defining two interior cavities having about half the total length of the cavity. The height of the baffle being less than or equal to the height of the box less the length of the interior cavity. The front wall has an angled divider extending upwardly and inwardly therefrom. The angled divider is divided at the divider wall into two portions of differing lengths with each portion having an upper divider extending upwardly from the top thereof. The top of the upper divider is proximate to but less than the height of the box.

6 Claims, 5 Drawing Sheets

AMMUNITION BOX

TECHNICAL FIELD

This invention relates to ammunition boxes, and, more particularly, to ammunition boxes designed for belted munitions used to feed rapid fire weapons such as gatling guns.

BACKGROUND OF THE INVENTION

Rapid fire arms such as gatling guns and machine guns requires the use of ammunition boxes for storage of the large quantity of munitions needed to supply such weapons. In general, such weapons utilized individual bullets joined or linked by a continuous belt. The belted munitions are folded into ammunition boxes and fed therefrom to the particular weapon. Ammunition boxes generally present a box-like shape with a narrow width compared to the length and height dimensions. Such boxes are generally wide enough two rows of bullets separated by a divider wall.

However, it became apparent because of the longitudinal profile of bullets, namely, the pointed projectile end and fatter powder cartridge base, the cartridge base stacks are higher than the projectile end. This non-symmetric stacking has been known to cause interliking of adjacent folded belts leading to jamming of the ammunition belt and subsequent loss of weapons fire until the jam is cleared.

To rectify, soldiers learned to create a cross divider using the ammunition belt itself. The soldier loading the ammunition box takes a length of the bottom layer of the belt and folds it against itself. The folded section is arranged vertically thereby creating a corresponding widthwise bend in the remaining folds of the belts placed atop the folded section.

However, this leads to inconsistent ammunition belt loads. If the folded section is too tall, the ammunition box cannot be loaded as full as normally desired. If too short, the benefits of the folding are eventually lost in the top folds of the ammunition belt.

Another source of jamming with present ammunition boxes is the crossover point where the belt crosses from one side of the divider wall to the other. Since the front portions of the boxes are generally of equal height, on occasion, the belt portion crossing over inadvertently entangles with the remaining portion of the belt also causing a jam.

Thus, there is a need for an ammunition box which provides a consistent load without jamming. The present invention meets this need.

SUMMARY OF THE INVENTION

It is an object of this invention to provide a simple, easy to use ammunition box providing a consistent ammunition load.

It is an object of this invention to provide an ammunition box which minimizes ammunition jamming.

Further objects and advantages of the invention will become apparent as the following description proceeds and the features of novelty which characterize this invention will be pointed out with particularity in the claims annexed to and forming a part of this specification.

DESCRIPTION OF THE PREFERRED EMBODIMENT

Figure 1:
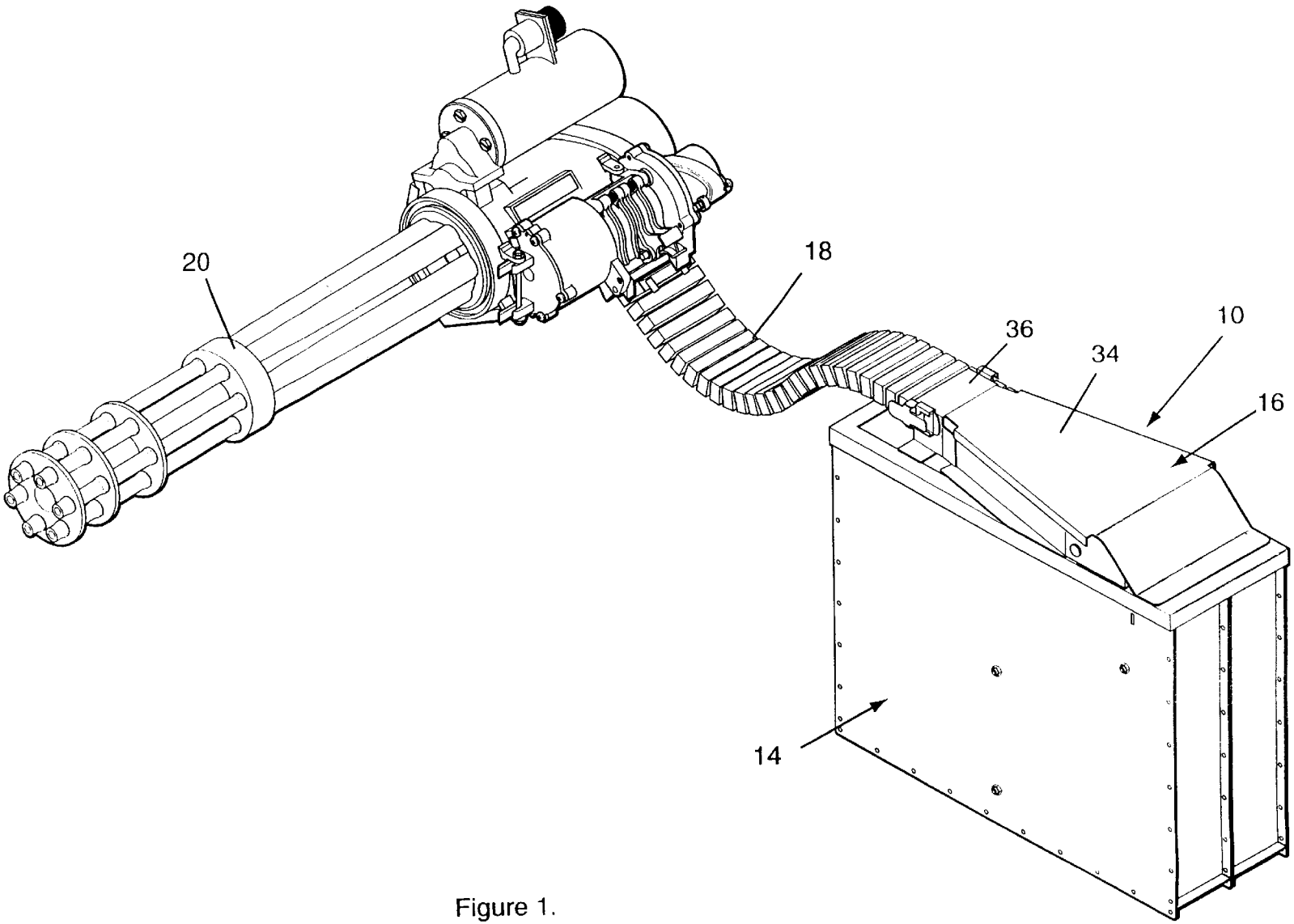
FIG. 1 is a perspective view of the ammunition box and liner of the present invention feeding a gatling gun.

Referring more particularly to the drawings by characters of reference, FIGS. 1–2, 5–7 disclose an ammunition box 10 which includes a housing 12 and a top 16 used to store and feed an ammunition belt 18 to a rapid fire weapon such as the gatling gun 20 illustrated herein. In one embodiment of the present invention, a liner 14 is employed to allow a prior art ammunition box 10 to employ the present invention. It will be understood by those skilled in the art that employing liner 14 of the embodiment of FIGS. 1–2, 5–7 is useful for such conversions. However, in other embodiments illustrated in FIGS. 3–4, the principles of the present invention are employed in an ammunition box 10 directly without use of liner 14.

Figure 2:
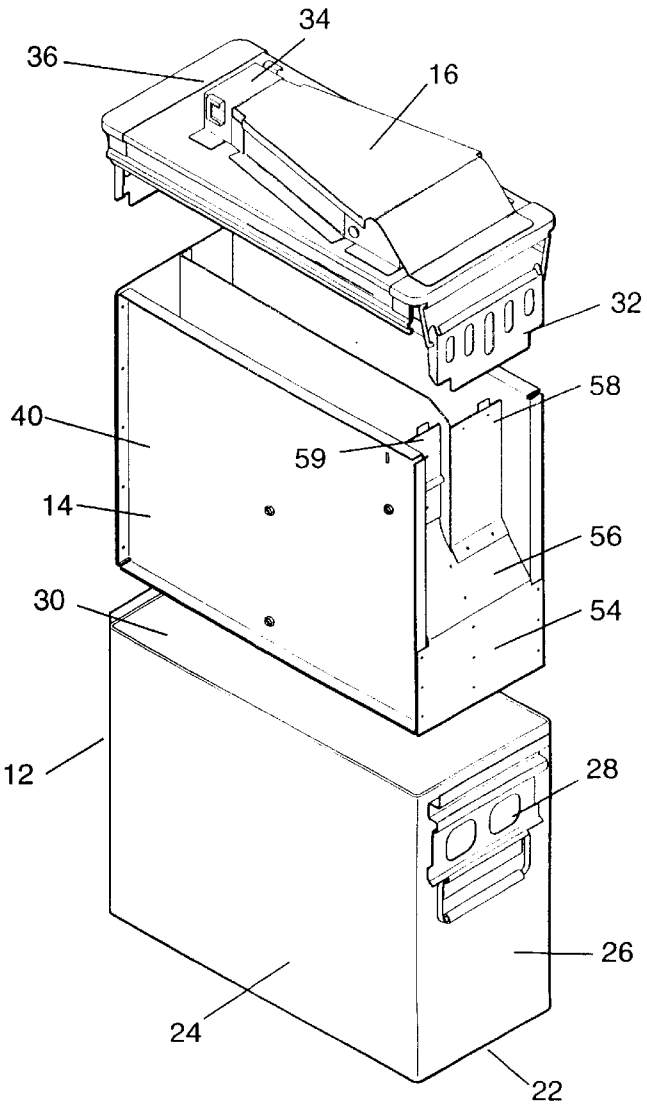
FIG. 2 is an exploded view of the ammunition box and liner of FIG. 1.
Figure 2:
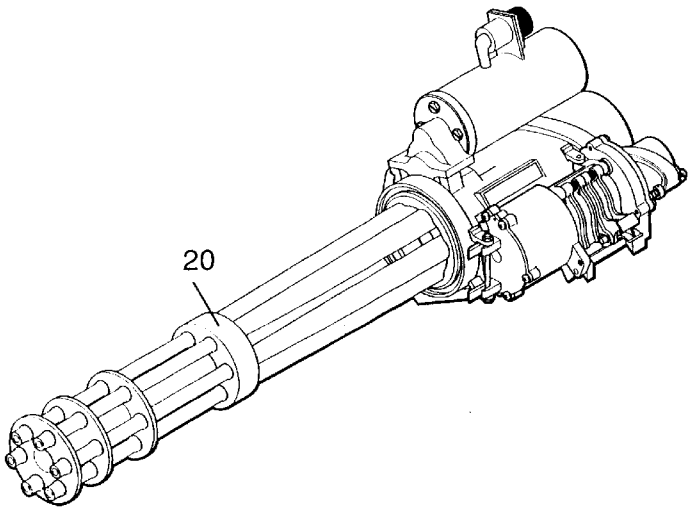

As best seen in FIG. 2, housing 12 is an open top, narrow width, box-like structure having a bottom 22, two opposing side walls 24, a front wall 26 having a housing lock mechanism 28 mounted thereon proximate to the top thereof, and a rear wall 30 opposing front wall 26.

Top 16 mates with the open top of housing 12 and includes a corresponding top lock mechanism 32 mounted on the front of top 16 and cooperating with housing lock mechanism 28 to secure top 16 to housing 12. Top 16 includes a feeder spout 34 which extends the width of housing 12 at the front thereof and tapers to a horizontally oriented opening 36 which adapted to allow ammunition belt 18 to extend therefrom as shown in FIG. 1.

Figure 3:
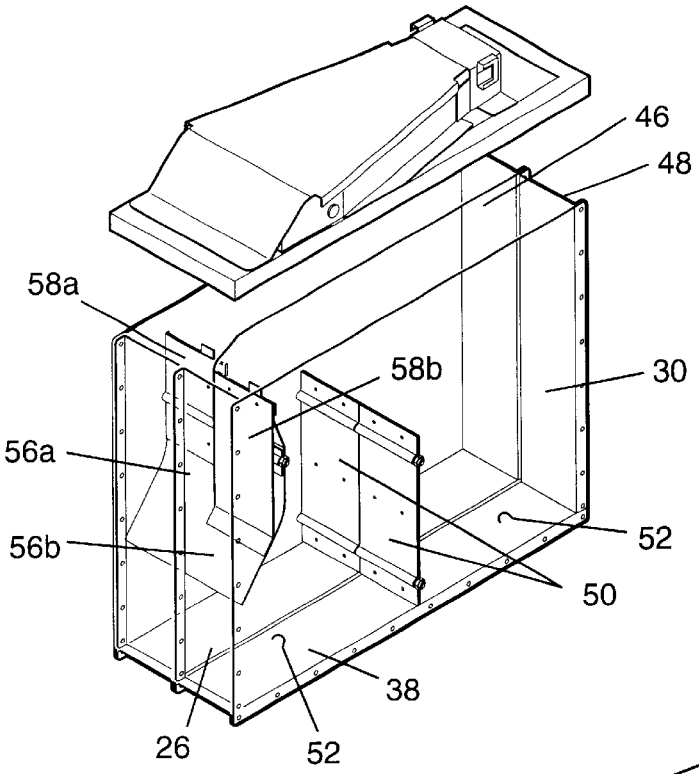
FIG. 3 is a perspective side view of an alternate embodiment of an ammunition box of FIG. 1 showing the interior structure thereof.
Figure 4:
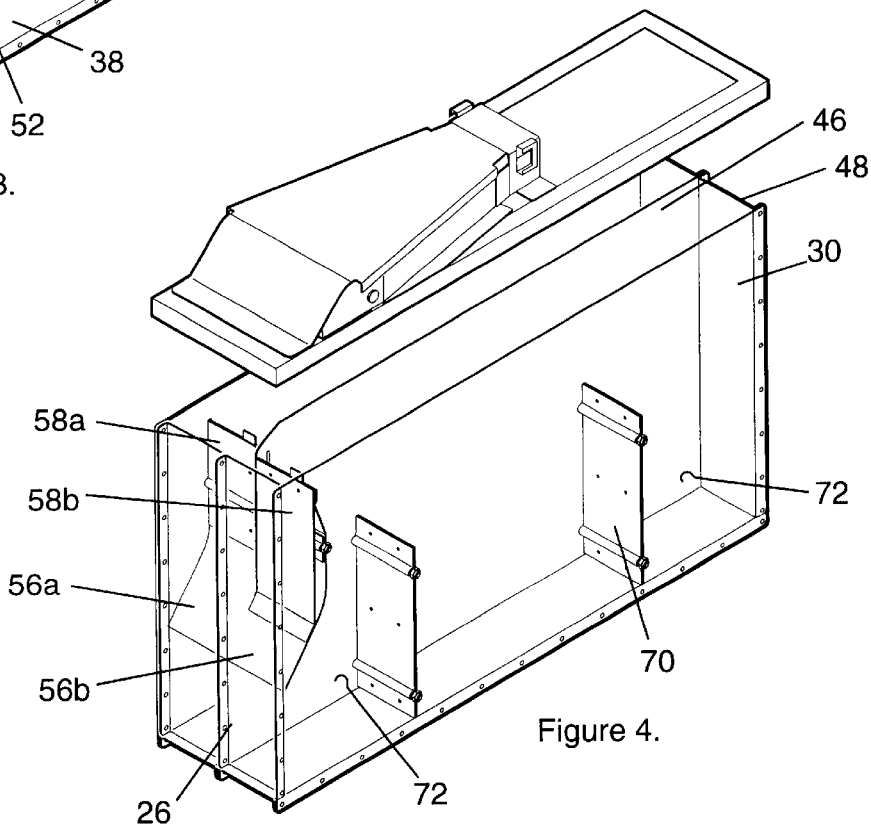
FIG. 4 is a perspective side view of still another embodiment of the ammunition box of FIG. 1 showing the interior structure thereof.

Extending the length and height of housing 12 in the embodiments of FIGS. 3–4 and bisecting the width of housing 12 is a vertical divider wall 46 which divides the interior of housing 12 into two equal width cavities 48. Each cavity 48 is wide enough to receive the width of ammunition beft 18 therein.

Extending the width of each cavity 48 and approximately bisecting the length of housing 12 is a baffle 50. Baffle 50 creates two interior cavities 52 having approximately half the total length of cavity 48. The height of baffle 50 is key to the invention. That height is preferably designed to less than or equal to the height of the box less the length of an interior cavity 52, and most preferably, equal to the height of the box less the length of an interior cavity 52.

As best seen in FIG. 3, at a point about ⅓ of the height of front wall 26 is an angled divider 56. Angled divider 56 is divided at its intersection with divider wall 46 into two halves **56*a* and 56*b* which are of differing lengths. Extending upwardly from the top of each half 56*a* and 56*b* is corresponding upper divider 58*a* and 58*b*. The top of upper dividers 58 is proximate to but less than the height of housing 12 by at least the thickness of ammunition belt 18 whereby the top of upper dividers 58, top 16 and side walls 24 define a gap 59. This arrangement provides that upper dividers 58*a* and 58*b* are parallel but separated in the lengthwise direction also by about the thickness of ammunition belt 18. In addition, front wall 26 in combination with angled dividers 56 and upper dividers 58 define a forward cavity 60**.

Figure 5:
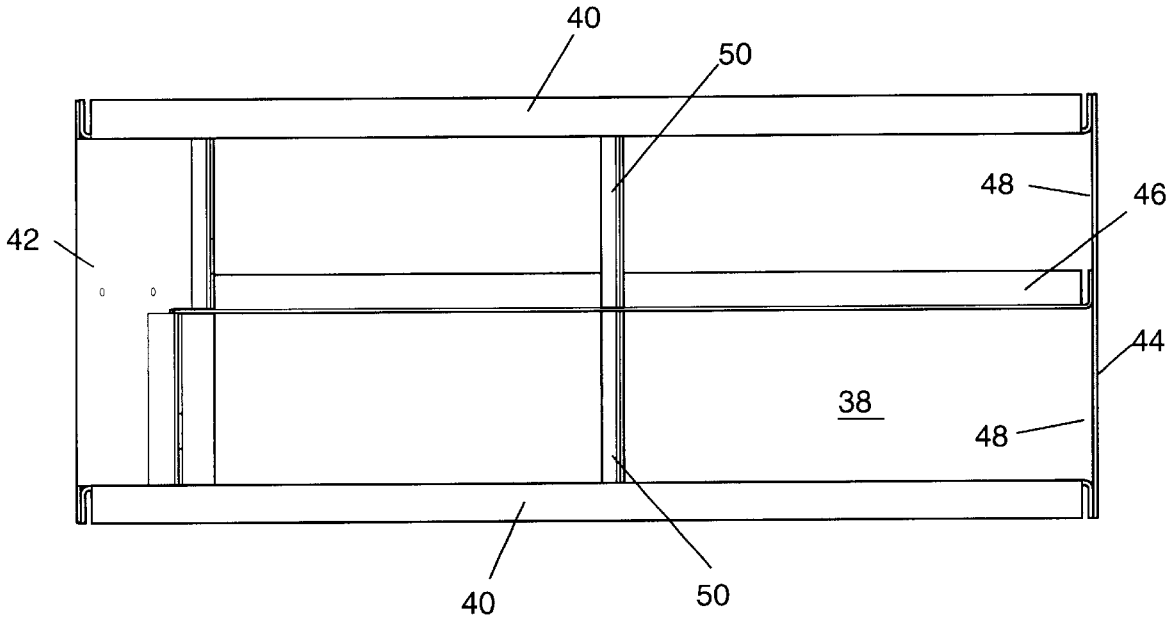
FIG. 5 is a top view of the liner of the embodiment of FIG. 1.

Turning now to the alternate embodiments of FIGS. 1–2 and FIG. 5, liner 14 comprises an open top, narrow width, box-like structure having a liner bottom 38, two opposing liner side walls 40, a liner front wall 42 and a liner rear wall 44 opposing liner front wall 42. Liner 14 is adapted to be slidably received within housing 12 and secured therein when lock mechanisms 28 and 32 are engaged. It should be noted that elements discussed in connection with liner 12 are given the to same numbers as elements discussed in connection with housing 12.

Extending the length and height of liner 14 in the embodiment of FIGS. 1–2, 5 and bisecting the width of liner 14 is vertical divider wall 46 which divides the interior of liner 14 into cavities 48. Each cavity 48 is wide enough to receive the width of anmmunition belt 18 therein.

Extending the width of each cavity 48 and approximately bisecting the length of liner 14 is baffle 50. Baffle 50 creates two interior cavities 52 which having approximately half the total length of cavity 48. The height of baffle 50 is the same as previously discussed, namely, that height is preferably designed to less than or equal to the height of the box less the length of an interior cavity 52, and most preferably, equal to the height of the box less the length of an interior cavity 52.

As best seen in FIG. 3, liner front wall 42 includes a forward portion 54 extending upwardly from liner bottom 38. Extending upwardly and inwardly from the top of forward portion 54 is angled divider 56. As shown, the width of angled divider 56 is divided at the intersection with divider wall 46 into two halves 56*a* and 56*b* which are of differing lengths. Extending upwardly from the top of each half 56*a* and 56*b* is corresponding upper dividers 58*a* and 58*b*. The top of upper dividers 58 is proximate to but less than the height of liner 14 by at least the thickness of ammunition belt 18 whereby the top of upper dividers 58, top 16 and liner side walls 40 define a gap 59. This arrangement provides that upper portions 58*a* and 58*b* are parallel but separated in the lengthwise direction also by about the thickness of ammunition belt 18. In addition, liner front wall 42 in combination with front wall 26 and side walls 24 of outer housing 12 define forward cavity 60.

Figure 6:
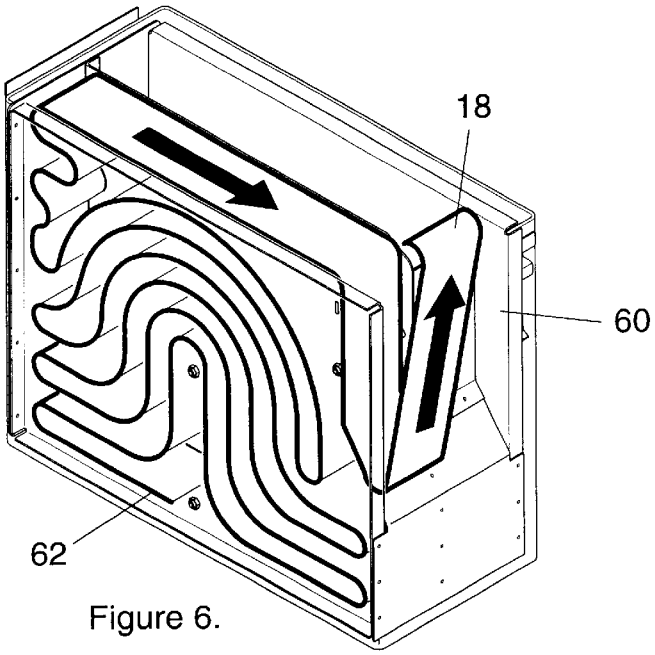
FIG. 6 is a perspective top and side view of the embodiment of FIG. 1 showing how an ammunition belt is wound within the first half of the present invention.

As best seen in FIG. 6, an end 62 of ammunition belt 18 is positioned proximate to a baffle 50 within shorter length cavity 48. Ammunition belt 18 is then extended to rear wall 30 where it is folded over on itself to return to baffle 50. Belt 18 is wound over upwardly over baffle 50 to the other side thereof where belt 18 drops downwardly towards liner bottom 38, forwardly to front wall 26. Belt 18 is then folded over on itself again to return to baffle 50, upwardly over baffle 50 and then downwardly on the rearward side of baffle 50. This winding procedure is continued until the entire first cavity 48 is full.

Figure 7:
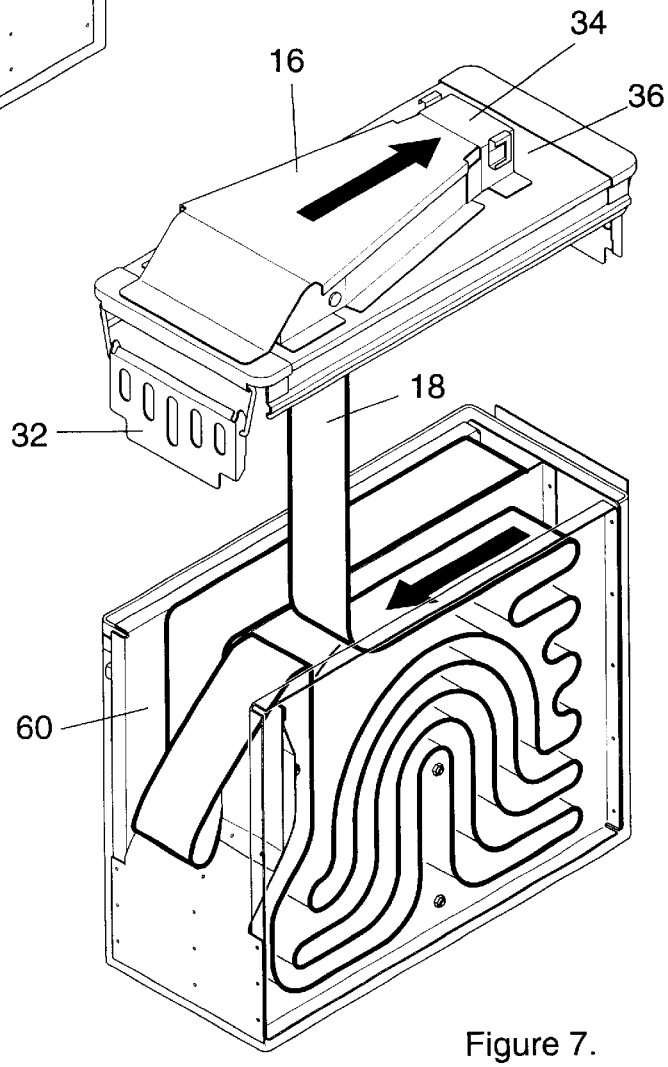
FIG. 7 is a perspective top and side view of the embodiment of FIG. 1 showing how an ammunition belt is wound within the second half of the present invention.

Once the first cavity is full, belt 18 is extended through the first gap 59 to forward cavity 60. As best seen in FIG. 7, belt 18 is folded over within cavity 60 and then extended through the second gap 59 into the second, longer cavity 48. Belt 18 is wound down front wall 26 to bottom 22, to and over baffle 50, to rear wall 30. Belt 18 is then folded back on itself as described previously until the second cavity is also full. Belt 18 is then wound through spout 34 to gatling gun 20.

Baffle 50 described above provides a consistent ammunition load while avoiding jamming of the ammunition belts. Use of staggered angled divider 56 and upper divider 58 combination also prevents jamming during the fold over from the two cavities.

Turning now to FIG. 4, a longer ammunition box 10 is provided. In this use, more than one baffle 50 is provided. The height rules for more than one baffle also apply. In the illustrated example, two baffles 50 are employed in each cavity 48. Baffles 50 divide cavity 48 into a center or interior cavity 70 which is formed between the two baffles 50 and two end cavities 72 which is formed between one baffle 50 and either front wall 26 or rear wall 30. To accommodate the fold over, each end cavity 72 is only one half the length of interior cavity 70.

Although only certain embodiments have been illustrated and described, it will be apparent to those skilled in the art that various changes and modifications may be made therein without departing from the spirit of the invention or from the scope of the appended claims.

What is claimed is:

1. An ammunition box for use with rapid fire weapons, the ammunition box comprising:

an open top box-like structure having a narrow width, the structure having a front wall having an angled divider extending upwardly and inwardly from the front wall, the angled divider being divided at the vertical divider into two portions of differing lengths, an upper divider extending upwardly from the top of each of the angled divider portions, the top of the upper divider being proximate to but less than the height of the structure, a vertical divider extending the length and height of the structure and bisecting the width of the structure dividing the interior thereof into two equal width cavities, each cavity being adapted to receive the width of an ammunition belt, and at least one baffle extending the width of each cavity dividing the length of the structure, thereby defining at least two interior cavities dividing into about equal portions the length of the cavity, the height of the at least one baffle being less than or equal to the height of the structure less the length of the at least two interior cavities.

2. The ammunition box of claim 1 further comprising a top mating with the open top of the structure, the top having a feeder spout extending the width of the structure at the front thereof and tapering to a horizontally oriented opening which is adapted to allow an ammunition belt to extend therefrom.

3. The ammunition box of claim 2 further comprising a lock mechanism mounted on the front wall proximate to the top thereof and a corresponding top lock mechanism mounted on the front of top and cooperating with the housing lock mechanism to secure the top to the outer housing.

4. The ammunition box of claim 1 wherein the height of the at least one baffle is equal to the height of the structure less the length of the interior cavity.

5. The ammunition box of claim 1 further having two or more baffles within each cavity, the baffles defining one or more interior cavities having equal length and the baffles and the liner front wall and the liner rear wall defining two end cavities, each end cavity being only one half the length of the one or more interior cavities.

6. An ammunition box liner for use with an ammunition box for rapid fire weapons, the ammunition box liner comprising:

an open top, narrow width, box-like structure being adapted to be slidably received within an ammunition box, the liner further having a vertical divider extending the length and height of the liner and bisecting the width of the liner dividing the interior of the liner into two equal width cavities, each cavity being adapted to receive the width of an ammunition belt, the liner further having two or more baffles within each cavity, the baffles defining one or more interior cavities having equal length and the baffles and the liner front wall and the liner rear wall defining two end cavities, each end cavity being only one half the length of the one or more interior cavities, the height of the each of the two or more baffles being less than or equal to the height of the box less the length of the interior cavity.

* * * * *